United States Patent [19]

Umemura

[11] Patent Number: 4,934,488

[45] Date of Patent: Jun. 19, 1990

[54] DOOR LOCK FOR AN ELEVATOR CAR

[75] Inventor: Setsuo Umemura, Inazawa, Japan

[73] Assignee: Mitsubishi Denki Kabushiki Kaisha, Japan

[21] Appl. No.: 219,570

[22] Filed: Jul. 15, 1988

[30] Foreign Application Priority Data

Jul. 18, 1987 [JP] Japan ..... 62-179404

[51] Int. Cl.[5] ..... B66B 13/00

[52] U.S. Cl. ..... 187/57; 187/49; 187/61; 49/116

[58] Field of Search ..... 187/57, 61, 49, 50, 187/30, 56; 49/404, 116, 31

[56] References Cited

U.S. PATENT DOCUMENTS

| | | | |
|---|---|---|---|
| 1,268,109 | 6/1918 | Furlow | 187/61 |
| 3,912,049 | 10/1975 | Holland et al. | 187/61 |
| 4,423,799 | 1/1984 | Glaser et al. | 187/57 |
| 4,512,443 | 4/1985 | Dewhurst | 187/57 |

FOREIGN PATENT DOCUMENTS

| | | | |
|---|---|---|---|
| 239218 | 10/1911 | Fed. Rep. of Germany | 187/61 |
| 54-47254 | 4/1979 | Japan . | |
| 54-127358 | 9/1979 | Japan . | |
| 54-138259 | 10/1979 | Japan . | |
| 5611 | of 1912 | United Kingdom | 187/49 |

*Primary Examiner*—Michael S. Huppert
*Assistant Examiner*—Kenneth Noland
*Attorney, Agent, or Firm*—Leydig, Voit & Mayer

[57] ABSTRACT

A door lock for an elevator car has a latch which is linked with a pivot arm which is pivotably mounted on the elevator car. The latch and the pivot arm can rotate together between a latched position, in which the doors are locked by the latch, and an unlatched position, in which the doors are released. The pivot arm is rotated from the latched to the unlatched position when it contacts any one of a plurality of cams which are installed on the wall of the elevator shaft in which the elevator car is housed. The cams are located such that when the pivot arm contacts a cam, the elevator car is in a position where it is safe to open the doors of the elevator car. The door lock may be further equipped with an electrically-controlled actuator which rotates the latch and the pivot arm to a second latched position in which the doors are locked by the latch and the pivot arm will not contact the cams.

16 Claims, 4 Drawing Sheets

DOOR LOCK FOR AN ELEVATOR CAR

BACKGROUND OF THE INVENTION

This invention relates to a door lock for an elevator car. More particularly, it relates to a door lock for an elevator car which is easier and less expensive to install than a conventional door lock.

The doors of an elevator car are typically equipped with a door lock which prevents the doors from being opened unless the location of the elevator car within the elevator shaft is such that it is safe for the doors to open. As it is necessary that the lock continue to operate even when electrical power to the elevator is cut off, such as during a power failure, it must be possible for the door lock to be locked and unlocked mechanically. For example, Japanese Examined Published Patent Application No. 59-17031 discloses an elevator car door lock with a mechanical latch which is latched or unlatched in accordance with whether there is contact between a pivot arm, which is mounted on the elevator car, and a cam, which is secured to the inside of the elevator shaft. The cam is a member which projects from the side of the elevator shaft and extends vertically for the entire length of the elevator shaft except for those locations where it is safe for the elevator car doors to open. The latch operates such that the elevator car doors are locked when the pivot arm contacts the cam, and the doors are unlocked when there is no contact therebetween.

With this structure, the cam which is used to operate the latch is extremely long and cumbersome, and therefore it is time-consuming and expensive to install and adjust the cam.

SUMMARY OF THE INVENTION

Accordingly, it is an object of the present invention to provide a door lock for an elevator car which is easier and cheaper to install and adjust than a conventional door lock.

It is another object of the present invention to provide a door lock for an elevator car which can be used on a high-speed elevator without generating noise during operation.

A door lock for an elevator car in accordance with the present invention has a latch which can be mechanically operated by a pivot arm. The pivot arm and the latch are normally in a latched position and are both rotated to an unlatched position when the pivot arm comes into contact with any one of a plurality of cams which are attached to the wall of the elevator shaft in which the elevator car is disposed. The cams are disposed in the elevator shaft only in locations where it is safe for the doors of the elevator car to open, in contrast to conventional door locks in which the cams are disposed in locations where it is unsafe for the doors to open. Accordingly, the cams of a door lock of the present invention are small, making them easy to install and adjust.

In accordance with one form of the present invention, a door lock for an elevator car comprises a latch which is pivotably mounted on the elevator car and which can pivot between a latched position in which it prevents the doors of the elevator car from being opened and an unlatched position in which the elevator car doors are free to open a pivot arm which is pivotably mounted on the elevator car and which can rotate between a latched position and an unlatched position together with the latch, biasing means for biasing the latch and the pivot arm towards their latched positions, and a pluarilty of cams which are disposed on the wall of the elevator shaft where the pivot arm can come in contact with the cams. The pivot arm is moved from the latched position to the unlatched position when it contacts one of the cams. The cams are positioned such that when the pivot arm is in contact with one of the cams, the elevator car is in a location where it is safe to open the elevator car doors.

In accordance with another form of the present invention, a door lock for an elevator car has a latch and a pivot arm which can rotate together between an unlatched position and two different latched positions. In one of the latched positions, the pivot arm can contact the cams, and in the other latched position, the pivot arm is rotated away from the cams so as not to contact them during high-speed operation. The door lock is further equipped with an electrically-controlled actuator for rotating the pivot arm and the latch to the latched position in which the pivot arm can not contact the cams.

In preferred embodiments, the elevator car to which the present invention is applied is one which is equipped with two sliding doors which open and close by sliding in opposite directions from one another. However, the door lock of the present invention can be used with various types of elevator cars, and there is no restriction on the number of doors on the elevator car or the direction in which they open.

The cams which are installed on the elevator shaft need not have any particular shape, and it is only necessary that they protrude from a wall of the elevator shaft sufficiently to make the pivot arm rotate from a latched position to an unlatched position when it contacts one of the cams.

Instead of cams, it is also possible to form depressions in the wall of the elevator shaft, and to have the pivot arm rotate from a latched position to an unlatched position when it contacts one of the depressions.

The latch which is used to lock and unlock the elevator doors need not have any particular shape. The latch and the pivot arm can be connected together by any means which enables them to rotate together as a unit between their latched and unlatched positions. For example, in one preferred embodiment, the latch and the pivot arm are secured to opposite ends of a rigid rotating shaft. In another preferred embodiment, the latch and the pivot arm are connected with one another by a cable.

BRIEF DESCRIPTION OF THE DRAWINGS

In the drawings, the same reference numerals indicate the same or corresponding parts.

DESCRIPTION OF THE PREFERRED EMBODIMENTS

Figure 1:
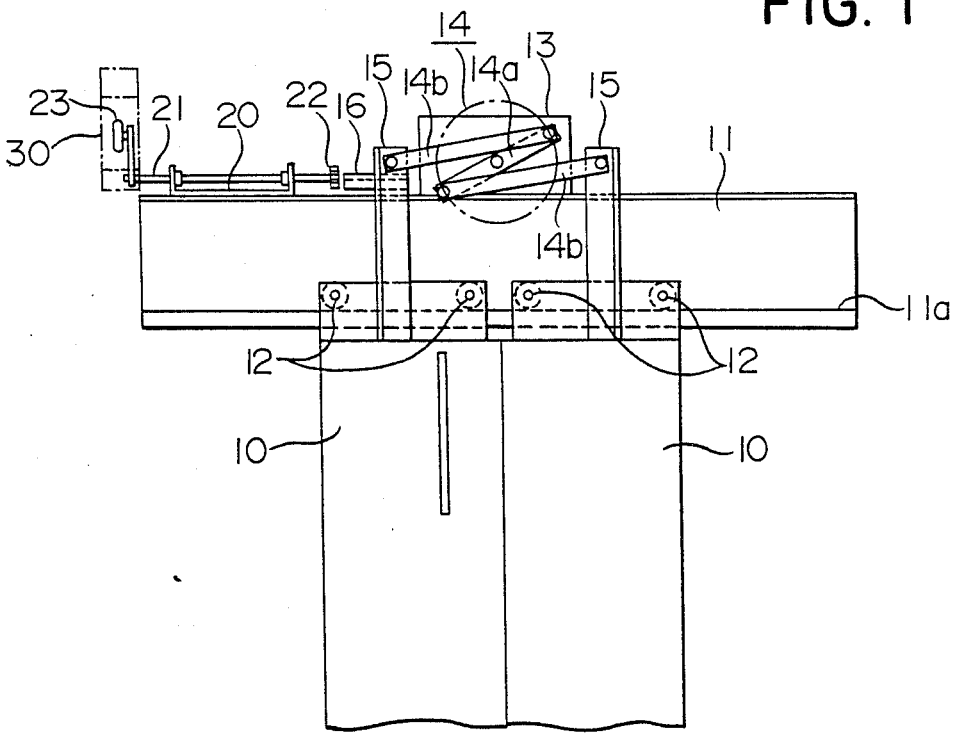
FIG. 1 is a front view of a first embodiment of an elevator car door lock in accordance with the present invention as seen from the inside of an elevator car.

Hereinbelow, a number of preferred embodiments of an elevator car door lock in accordance with the present invention will be described while referring to the accompanying drawings, FIGS. 1 and 2 of which illustrate a first embodiment. As shown in FIG. 1, which is a front view of this first embodiment as seen from the inside of an elevator car, the elevator car has a pair of sliding doors 10 which are supported by an upper frame 11 of the elevator car so as to be able to slide to the right and left. The doors 10 have a plurality of rollers 12 which are rotatably mounted on the upper portion thereof and which can roll along the upper surface of a rail 11*a* formed on the bottom of the upper frame 11. A door extension 15 in the form of an angle bar is secured to the top portion of each door 10 and extends upwards to above the upper frame 11. A door opening and closing mechanism 13 is mounted atop the upper frame 11. It houses an unillustrated motor, a reduction gear, and an output shaft which is driven by the motor through the reduction gear. The rotation of the output shaft of the opening and closing mechanism 13 is converted into linear motion by a crank and link assembly 14 which comprises a central crank 14 which is secured to the output shaft and a pair of links 14*b* whose inner ends are pivotably connected to the outer ends of the crank 14*a*. The outer ends of the links 14*b* are pivotably connected to the upper ends of the door extensions. 15. When the motor of the opening and closing mechanism 13 is operated, the rotation of the drive shaft is converted to linear motion by the crank and link assembly 14, and the sideways force exerted by the links 14*b* is transmitted by the door extensions 15 to the doors 10, which are made to close or open by sliding towards/or away from one another.

A shaft support 20 which journals a shaft 21 is secured to the top of the upper frame 11. A latch 22 is secured to one end of the shaft 21, while a pivot arm 23 is secured to the opposite end of the shaft 21. A ridid member in the form of a horizontal angle iron 16 is secured by a bolt 16*a* to the upper portion of the door extension 15 which is nearest the latch 22. The latch 22 is designed to prevent or allow the sideways movement of the angle iron 16, thereby locking or unlocking the doors 10 of the elevator car.

Figure 2:
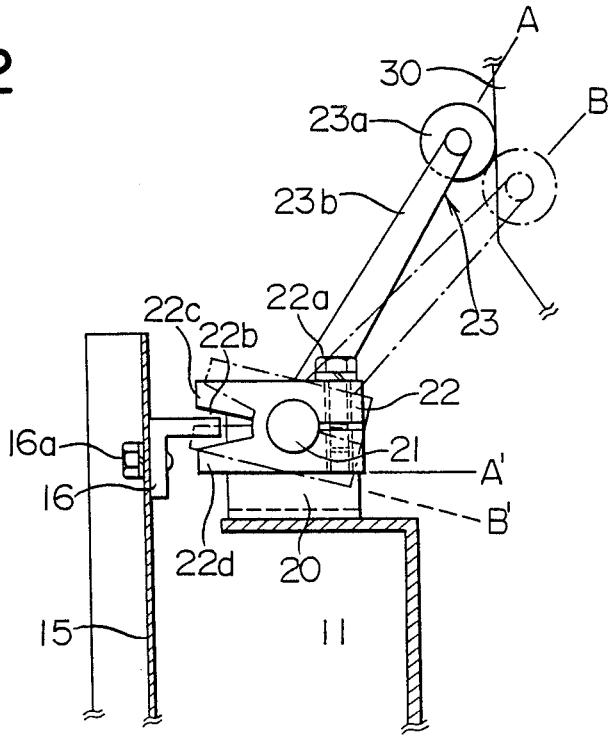
FIG. 2 is a side view of the embodiment of FIG. 1.

The structure of the latch 22 and the pivot arm 23 is shown more clearly in FIG. 2. The latch 22 is a rigid plate having a hole at its center into which the end of the shaft 21 extends. As shown in FIG. 2, the right side of the latch 22 is split into two confronting portions by a gap which extends from the hole at the center of the latch 22 to the right end thereof. The latch 22 is clamped tightly onto the end of the shaft 21 by a compressive force which is exerted by a bolt 22*a* which screws into the two confronting portions of the right side of the latch 22. The left side of the latch 22 has an upper projection 22*c* and a lower projection 22*d* which are separated by a roughly V-shaped notch 22*b*.

The pivot arm 23 comprises an arm 23*b* whose inner end is secured to the shaft 21 and a roller 23*a* which is rotatably mounted on the outer end of the arm 23*b*. The pivot arm 23 can rotate between an unlatched position A, shown by solid lines in FIG. 2, and a latched position B, shown by dashed lines. Similarly, the latch 22 can rotate between an unlatched position A′, shown by solid lines, and a latched position B′, shown by dashed lines. As the latch 22 and the pivot arm 23 are rigidly connected to one another by the shaft 21, when the latch 22 is in unlatched position A′ or latched position B′, the pivot arm 23 is respectively in unlatched position A or latched position B. In unlatched position A′, the latch 22 is oriented such that the angle iron 16 can freely move horizontally through the notch 22*b* of the latch 22. Therefore, when the latch 22 is in unlatched position A′, the doors 10 can be opened. In its latched position B′, the latch 22 is rotated so that the lower projection 22*d* blocks the horizontal movement of the angle iron 16, and therefore the doors 10 are prevented from being opened.

A plurality of cams 30 are mounted on one of the walls of the unillustrated elevator shaft in which the elevator car is disposed. Each cam 30 is disposed in a location such that when the elevator car is situated where it is safe to open the doors 10, the roller 23*a* of the roller arm 23 will be in contact with one of the cams 30. The roller arm 23 is biased in the clockwise direction in FIG. 2 by a biasing means in the form of an unillustrated biasing spring, so that when the roller 23*a* is not in contact with one of the cams 30, the roller arm 23 and the latch 22 will be rotated towards the latched positions B and B′. On the other hand, the height of each came 30 from the wall of the elevator shaft is such that when the roller 23*a* of the pivot arm 23 rides up atop the cam 30, the pivot arm 23 will be pivoted from its latched position B to its unlatched position A.

The operation of the illustrated embodiment is as follows. When the elevator car is traveling between the floors of the building in which it is installed, since there are no cams 30 between the floors of the buildings, the latch 22 and the pivot arm 23 are forced by the unillustrated biasing spring to pivot to their latched positions B and B′ shown by the dashed lines in FIG. 2. In this state, the horizontal movement of the angle bar 16 is blocked by the lower projection 22*d* of the latch 22, so the doors 10 of the elevator car can not be opened. When the elevator car reaches one of the floors of the building and arrives at a position where it is safe to open the elevator doors 10, the roller 23*a* of the pivot arm 23 will ride up onto one of the cams 30, and the pivot arm 23 and the latch 22 will together pivot against the force of the biasing spring from the latched positions B and B′ to the unlatched positions A and A′ shown by the solid lines in FIG. 2. In this state, the angle iron 16 is free to pass through the notch 22*b* in the latch 22, and the doors 10 of the elevator car can be opened by the opening and closing mechanism 13.

As the latch 22 is mechanically actuated, the doors 10 are locked and unlocked in the suitable locations of the elevator shaft even when no electricity is supplied to the elevator car. Therefore, if a power failure occured and the elevator car were stuck between floors in a position in which it were unsafe to open the doors 10, as the pivot arm 23 would not be in contact with one of the cams 30, the latch 22 would continue to prevent the doors 10 from being opened, and there would be no possibility of the passengers of the elevator injuring themselves in trying to leave the elevator car in a location in which it was unsafe to get off. Furthermore, if during a power failure the elevator car were stuck at safe location at which the pivot arm 23 contacted one of the cams 30, the latch 22 would automatically pivot to its unlatched position A', and the doors 10 could be opened by hand.

It can be seen that since the cams 30 used in the present invention are disposed only in locations corresponding to where it is safe for the doors 10 of the elevator car to open, each cam 30 is very small compared to a conventional cam and can be easily installed and adjusted. Therefore, the cost of installing an elevator car door lock in accordance with the present invention is much less than for a conventional door lock which employs long cams extending between the floors of a building.

In the embodiment of FIGS. 1 and 2, when the pivot arm 23 is in its latched position B, the roller 23*a* will contact every cam 30 it passes, even when the elevator car is not stopping at the floor at which the cam 30 is installed. This contact between the roller 23*a* of the pivot arm 23 and each cam 30 which the elevator car passes generates noise, and during high-speed operation of the elevator, this noise could be unpleasant to the passengers of the elevator.

Figure 3:
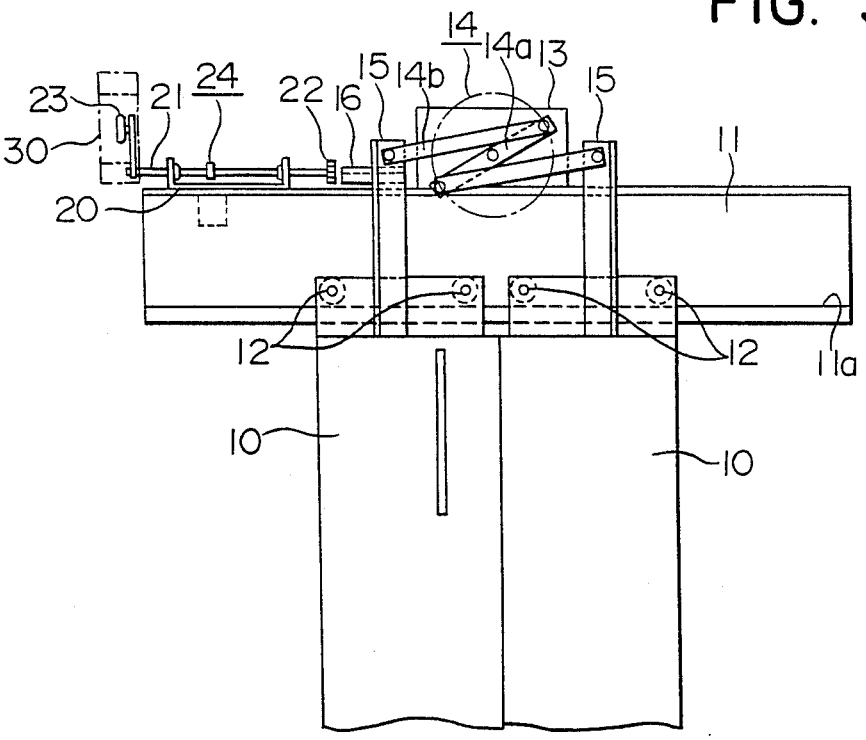
FIG. 3 is a front view of a second embodiment of the present invention as seen from the inside of an elevator car.
Figure 4:
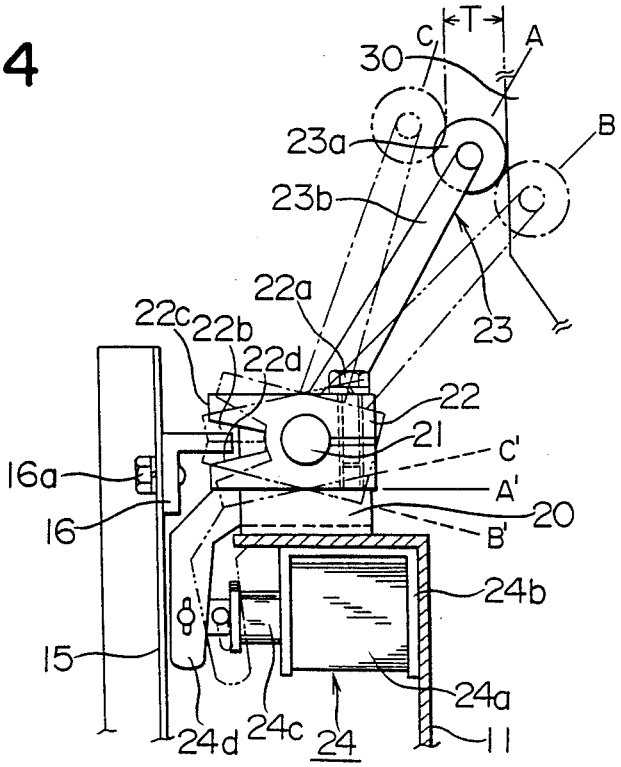
FIG. 4 is a side view of the embodiment of FIG. 3.

Accordingly, in a second embodiment of the present invention, the roller 23*a* of a pivot arm 23 is prevented from contacing cams 30 installed on the floors at which the elevator car is not going to stop, resulting in quieter operation. FIG. 3 and FIG. 4 are respectively a front view and a side view of this second embodiment. The overall structure of this embodiment is similar to that of the first embodiment, but this embodiment is further equipped with an elecrically-controlled actuator 24 for moving the pivot arm 23 to a position in which the roller 23*a* will not contact the cams 30 installed in the elevator shaft. The actuator 24 comprises a solenoid 24*a* which is surrounded by a yoke 24*b* which supports the solenoid 24*a* and forms a magnetic path. The yoke 24*b* is secured to the upper portion of the upper frame 11 beneath the shaft 21. A movable core 24*c* which is made of a magnetic material is slidably disposed inside the solenoid 24*a*. The outer end of the movable core 24*c* is pivotably connected to one end of a lever arm 24*d*. The opposite end of the lever arm 24*d* is secured to the shaft 21, whereby the longitudinal movement of the movable core 24*c* will make the shaft 21 pivot about its axis.

As shown in FIG. 4, the pivot arm 23 and the latch 22 can each pivot between three different positions: unlatched positions A and A' shown by the solid lines, first latched positions B and B' shown by the dashed lines with one short dash between every two long dashes, and second latched positions C and C' shown by the dashed lines with two short dashes between every two long dashes. The unlatched positions A and A' and the first latched positions B and B' are identical to the corresponding positions in FIG. 2. In second latched position C', the latch 22 is rotated counterclockwise by the shaft 21 from its unlatched position A' so that the angle iron 16 is latched by the upper projection 22*c* of the latch 22. In it second latched position C, the pivot arm 23 is rotated counterclockwise until the roller 23*a* of the pivot arm 23 is separated from the cams 30 in the elevator shaft by a distance T.

Normally, the pivot arm 23 and the latch 22 are biased towards the first latched positions B and B' by the unillustrated biasing spring. The pivot arm 23 and the latch 22 are pivoted to the second latched positions C and C' only when the actuator 24 is energized.

When no current is supplied to the solenoid 24*a* of the actuator 24, the movable core 24*c* is free to move in and out of the solenoid 24*a*. In this case, the operation of this embodiment is identical to that of the previous embodiment. However, when the elevator is traveling between floors which are not adjacent to one another, the solenoid 24*a* is energized by supplying current thereto, and the solenoid 24*a* draws the movable core 24*c* inwards, i.e., to the right in FIG. 4. The lever arm 24*d* is thereby pivoted counterclockwise from the position shown by the solid line to the position shown by the dashed line. This causes the shaft 21 to pivot counterclockwise, and the pivot arm 23 and the latch 22 are together pivoted to the second latched positions C and C'. In this state, the angle iron 16 is prevented from horizontal movement by the upper projection 22*c* of the latch 22, and the doors 10 can not be opened. At the same time, the roller 23*a* of the pivot arm 23 is pulled away from the wall of the elevator shaft so that the roller 23*a* will not contact any cams 30 which it passes. As a result, no noise will be produced by contact between the roller 23*a* and the cams 30, and quiet operation can be performed at high speeds.

Normally, the actuator 24 is energized from the time the elevator car starts to move until just before it reaches a floor where it is to stop, at which time the current to the solenoid 24*a* is stopped, whereby the pivot arm 23 and the latch 22 are free to pivot clockwise to the unlatched positions A and A' or the first latched position B and B'.

When there is a power failure, since the actuator 24 is elecrically powered, it exerts no torque on the shaft 21, and the operation of this embodiment is then identical to that of the previous embodiment. Therefore, during a power failure, if the elevator car stops in a location between two floors where it is unsafe to open the elevator doors, the pivot arm 23 and the latch will rotate to the first latched positions B and B', and the doors 10 will be kept locked by the latch 22. The doors 10 can be opened only when the elevator car has moved to a safe position in which the roller 23*a* of the pivot arm 23 contacts one of the cams 30 in the elevator shaft and the latch 22 has been pivoted to its unlatched position A'. When the elevator car is so situated, the doors 10 can then be opened by hand.

This embodiment otherwise provides the same benefits as the previous embodiment.

Figure 5:
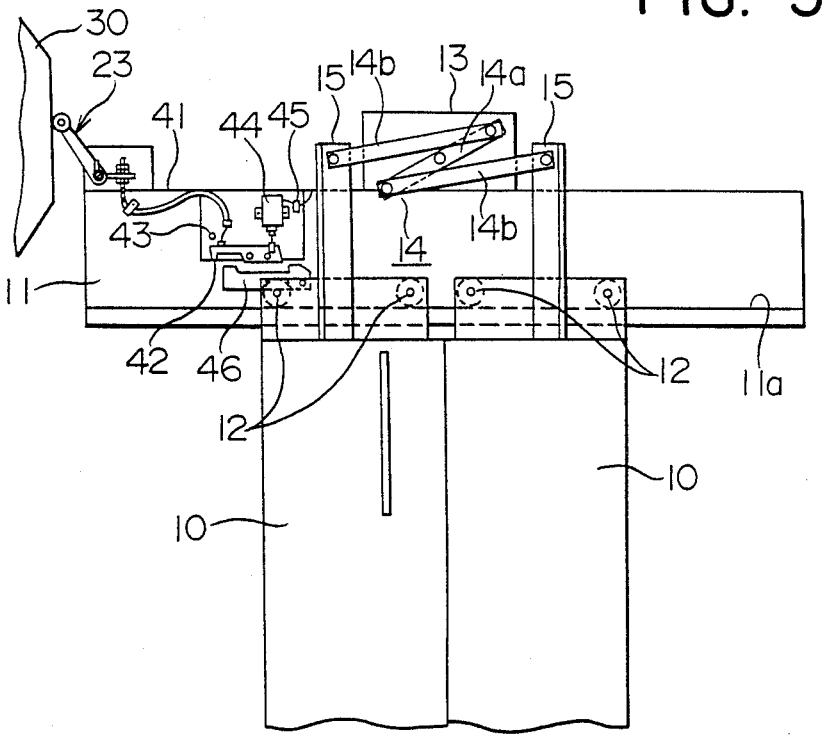
FIG. 5 is a front view of a third embodiment of the present invention as seen from the inside of an elevator car.
Figure 6:
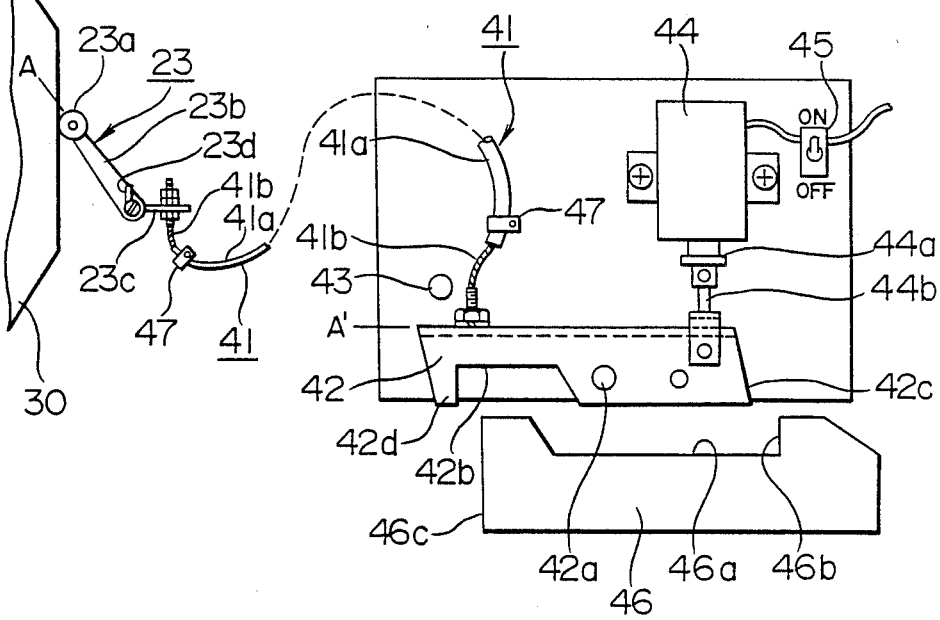
FIG. 6 through FIG. 8 are enlarged front views of portions of the embodiment of FIG. 5 at three different stages of operation.
Figure 7:
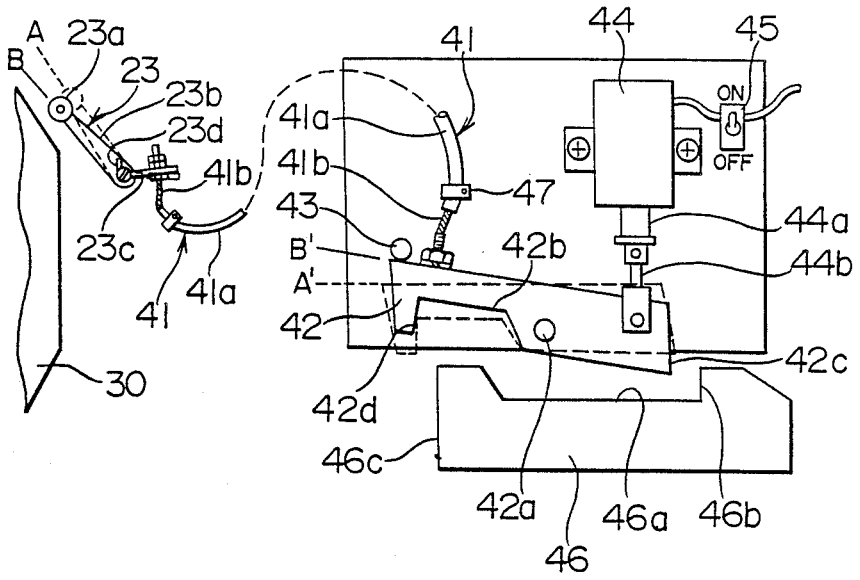
Figure 8:
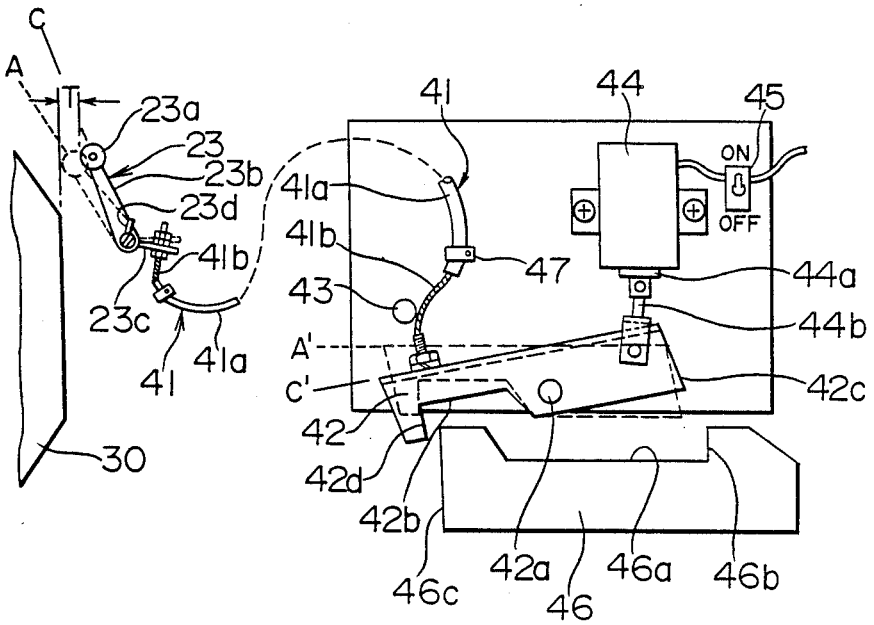

FIGS. 5 through 8 illustrate a third embodiment of an elevator car door lock in accordance with the present invention, FIG. 5 being a front view of the door lock as seen from the inside of an elevator car and FIGS. 6 through 8 being enlarged front views of portions of this embodiment during different stages of operation.

As shown in these figures, a pivot arm 23 is pivotably mounted on one end of the upper fram 11 of an elevator car. The pivot arm 23 comprises a main arm 23*b* on the outer end of which a roller 23*a* is rotatably mounted. A cable installation arm 23*c* which extends outwards from the main arm 23*b* is formed on the other end thereof. The pivot arm 23 is biased in the counterclockwise direction in the figures by a biasing means in the form of a coil spring 23*d*.

The pivot arm 23 can rotate between an unlatched position A shown in FIG. 6, a first latched position B shown by the solid lines in FIG. 7, and a second latched position C shown by the solid lines in FIG. 8. In the unlatched position A, the roller 23*a* contacts the top surface of one of a plurality of cams 30 installed in the elevator shaft. In the first latched position B, the pivot arm 23 is rotated counterclockwise from its unlatched position A towards the wall of the elevator shaft. In this position, it is not in contact with a cam 30, but is it able to contact one when the elevator car reaches an appropriate location in the elevator shaft. In the second latched position C, the pivot arm 23 is rotated clockwise from the unlatched position A away from the wall of the elevator shaft so that the roller 23*a* is separated from the cams 30 by a distance T. The cams 30 are situated such that the pivot arm 23 contacts one of the cams 30 only when the elevator car is in a location where it is safe for the doors 10 to be opened.

A latch 42 is pivotably mounted on the upper frame 11 by means of a support pin 42*a* which passes loosely through a hole at the center of the latch 42 and is secured to the upper frame 11. The latch 42 can pivot about the support pin 42*a* between a horizontal, unlatched position A' shown in FIG. 6, a first latched position B' shown by the solid lines in FIG. 7, and a second latched position C' shown by the solid lines in FIG. 8. The clockwise pivoting of the latch 42 is restricted by a stopper 43 which protrudes from the side of the upper frame 11. The latch 42 and the pivot arm 23 are linked to one another by a cable 41 which resembles the brake cable of a bicycle but which can transmit force when acting either in tension or compression. It has a sheath 41*a* which is secured to the side of the upper frame 11 by a number of clips 47, and a wire 41*b* which is able to slide back and forth inside the sheath 41*a*. One end of the wire 41*b* is connected to the cable installation arm 23*c* of the pivot arm 23, while the other end of the wire 41*b* is connected to the left end of the latch 42. With this structure, the pivoting motion of the latch 42 is transmitted to the pivot arm 23 and vice versa, the pivot arm 23 and the latch 42 always pivoting in opposite directions. Therefore, when the pivot arm 23 is in its unlatched position A, its first latched position B, or its second latched position C, the latch 42 is in its unlatched position A', its first latched position B', or its second latched position C', respectively. The latch 42 has a notch 42*b* formed therein on the left side of the support pine 42*a*. The right end surface of the latch 42 constitutes a first latching portion 42*c*, and the left side of the notch 46*b* constitutes a second latching portion 42*d*.

A rigid member in the form of a horizontally-extending plate 46 is secured to the upper portion of the door extension 15 of the lefthand door 10 of the elevator car. Like the latch 42, this plate 46 has a notch 46*a* formed in the center thereof. The right inner surface of the notch 46*a* constitutes a first contact portion 46*b* corresponding to the first latching portion 42*c* of the latch 42, and the left end surface of the plate 46 constitutes a second contact portion 46*c* corresponding to the second latching portion 42*d* of the latch 42.

The latch 42 can be made to pivot about the support pin 42*a* by an electrically-controlled actuator 44 which is secured to the side of the upper frame 11 by screws. The actuator 44 houses an unillustrated solenoid and a yoke which supports the solenoid and forms a magnetic path. A movable core 44*a* which is made of a magnetic material is slidably disposed inside the solenoid. The lower end of the movable core 44*a* is pivotably connected to the upper end of a connecting rod 44*b*, while the lower end of the connecting rod 44*b* is pivotably connected to the right end of the latched 42. Electric power is supplied to the actuator 44 through a switch 45. When the switch 45 is off, no power can be supplied to the actuator 44, and when the switch 45 is in the on position as shown in the figures, the supply of electric power to the actuator 44 is controlled by an unillustrated control mechanism. When no power is supplied to the actuator 44, the movable core 44*a* is free to move up and down inside the solenoid and exerts no torque on the latch 42. However, when the actuator 44 is energized, the movable core 44*a* is sucked in, i.e., upwards by the solenoid of the actuator 44, and the latch 42 is pivoted by the second latched position illustrated in FIG. 8.

The structure of the elevator car itself is identical to that of the elevator car of FIG. 1.

The operation of this embodiment is as follows. First, the operation when the actuator 44 is not energized will be described while referring to FIGS. 6 and 7. When the elevator car is positioned where it is safe for the doors 10 to open, the roller 23*a* of the pivot arm 23 contacts one of the cams 30 installed in the elevator shaft, and the pivot arm 23 is in the unlatched position A shown in FIG. 6. As the pivot arm 23 is linked to the latch 42 by the cable 41, the latch 42 will also be in its horizontal, unlatched position A' shown in FIG. 6. In this state, there is no contact between the latch 42 and the plate 46, so the plate 46 is free to move sideways, and the doors 10 of the elevator car can be opened either by the opening and closing mechanism 13 or by hand.

When the elevator car is moved away from a position in which it is safe to open the doors 10, the roller 23*a* loses contact with the cam 30, and the biasing force of the coil spring 23*d* rotates the pivot arm 23 counterclockwise from its unlatched position A (shown by the dashed lines in FIG. 7) to its first latched position B (shown by the solid lines). The rotatation of the pivot arm 23 is transmitted to the latch 42 by the cable 41, and the latch 42 is made to roate clockwise from its unlatched position A' (shown by the dashed lines in FIG. 7) to its first latched position B' (shown by the solid lines). The further clockwise rotation of the latch 42 is prevented by the stopper 43, which contacts the left end of the latch 42 when it is in its first latched position B'. In this position, the right end of the latch 42 is rotated downwards until the first latching portion 42*c* of the latch 42 confronts the first contact portion 46*b* of the plate 46. The first latching portion 42*c* thus prevents the horizontal movement of the plate 46, and the doors 10 of the elevator can not be opened either by the opening and closing mechanism 13 or by hand. Therefore, if electric power to the elevator is cut off due to a power failure or other cause and the elevator car is stuck between floors, there is no danger of the doors of the elevator car being opened until the elevator car can be moved to a location where it is safe to open them, i.e., in a location where the roller 23*a* contacts one of the cams 30.

When the elevator car is traveling directly between two floors which are not adjacent to one another, the actuator 44 is energized by an unillustrated control mechanism which supplies power to the solenoid of the actuator 44. When the solenoid is energized, it sucks the movable core 44*a* inwards, i.e., upwards to the position shown in FIG.8, and the upwards movement of the movable core 44*a* rotates the latch 42 counterclockwise to its second latched position C' shown by the solid lines in FIG. 8. The rotation of the latch 42 is transmitted to the pivot arm 23 by the cable 41, and the pivot arm 23 is rotated clockwise to its second latched position C shown by the solid lines. When the latch 42 is in its second latched position C', the left end of the latch 42 is rotated downwards so that the second latching portion 42*d* of the latch 42 confronts the second contact portion 46*c* of the plate 46. At the same time, the pivot arm 23 is in its second latched position C, so the roller 23*a* of the pivot arm 23 is moved away from the surface of the cams 30 by a distance T. As a result, the latch 42 prevents the horizontal movement of the plate 46, thereby locking the doors 10, and the roller 23*a* is prevented from contacting the cams 30 as the elevator car goes by floors at which it will not stop. Therefore, the elevator car can travel at high speeds without producing undesirable noise due to contact between the roller 23*a* and the cams 30. Just before the elevator car reaches the floor at which it is to stop, the current to the actuator 44 is cut off by the unillustrated control mechanism, and under the biasing force of the coil spring 23*d*, the latch 42 and the pivot arm 23 swing back to the first latched positions B and B', respectively, shown in FIG. 7.

If electric power to the elevator is cut off due to a power failure or othe cause at a time when the actuator 44 is energized, the actuator 44 will cease to exert any torque on the latch 42. Under the force of the coil spring 23*d*, the latch 42 and the pivot arm 23 will back to the unlatched positions of FIG. 6 or the first latched positions of FIG. 7, depending upon the position of the elevator car within the elevator shaft, and the operation of the embodiment will be the same as that described earlier for the case in which the actuator 44 is turned off.

This embodiment provides the same benefits as the previous embodiment.

In each of the preceding embodiments, the cams 30 which determine where it is safe to open the doors 10 of the elevator car are in the form of projections which are secured to a wall of an elevator shaft. However, it is instead possible for the cams to be in the form of projections which are an integral part of the wall of the elevator shaft itself.

Instead of mounting or forming cams on the wall of the elevator shaft, it is also possible to form depressions in the wall of the elevator shaft and to employ depressions in place of cams. With this arrangement, the pivot arm would be biased so as to normally contact the wall of the elevator shaft when in a latched position. When the pivot arm came into contact with one of the depressions, it would then pivot to an unlatched position. A door lock employing depressions would provide the same benefits as the above-described embodiments.

In the above-described second and third embodiments, the actuator which makes the pivot arm 23 rotate away from the cams 30 is in the form of a solenoid which indirectly drives the pivot arm 23. However, any type of electrically-controlled actuator which can make the roller 23*a* of the pivot arm 23 separate from the cams 30 can be employed. For example, it is possible to employ a solenoid which is directly connected to the pivot arm 23, and the actuator may employ a device other than a solenoid, such as an electric motor, for driving the pivot arm.

What is claimed is:

1. A door lock for an elevator car which is disposed inside an elevator shaft and which is equipped with at least one sliding door, comprising:

a latch which is pivotably mounted on said elevator car and which can pivot between a first latched position in which it latches said door in a closed position, a second latched position in which it latches said door in a closed position, and a unlatched position between the first and second latched positions in which said elevator car door is free to open;

a pivot arm which is pivotably mounted on said elevator car and which can rotate between a first latched position a second latched position, and an unlatched position between the first and second latched positions, said latch and said pivot arm being linked to rotate together between the positions, said pivot arm being in its first latched position, its second latched position, or its unlatched position when said latch is in its first latched position, its second latched position, or its unlatched position, respectively;

biasing means for biasing said latch and said pivot arm towards their respective first latched positions;

a plurality of cams disposed on a wall of said elevator shaft where said pivot arm can contact said cams, said pivot arm being moved from its first latched position to its unlatched position when it comes into contact with one of said cams, said cams being located for moving said pivot arm to its unlatched position only when said elevator car is in a location where it is safe to open said elevator car door.

2. A door lock as claimed in claim 1, wherein said pivot arm comprises an arm whose one end is pivotably mounted on said elevator car and a roller which is rotatably mounted on the other end of said arm and which contacts one of said cams when said pivot arm is in its unlatched position.

3. A door lock as claimed in claim 1, further comprising a shaft rotatably supported by said elevator car, said pivot arm and said latch being secured to said shaft for rotation with said shaft.

4. A door lock as claimed in claim 3, further comprising a rigid member secured to said door in a location such that movement of said rigid member in the direction of opening of said door is blocked by said latch when said latch is in either of its latched positions.

5. A door lock as claimed in claim 4, wherein said latch comprises a plate having a notch formed therein, said rigid member passing through said notch upon the opening of said door when said latch is in its unlatched position and said plate blocking the movement of said rigid member in the direction of opening of said door when said latch is either of its latched positions.

6. A door lock as claimed in claim 1, further comprising:

electrically-controlled actuator means for moving said pivot arm and said latch to their respective second latched positions, said pivot arm bein unable to contact said cams when it is its second latched position.

7. A door lock as claimed in claim 6, wherein said pivot arm comprises an arm whose one end is pivotably mounted on said elevator car and a roller which is rotatably mounted on the other end of said arm and which contacts one of said cams when said pivot arm is in its unlatched position.

8. A door lock as claimed in claim 6, further comprising a shaft rotatably supported by said elevator car, said pivot arm being secured to said shaft for rotation with said shaft.

9. A door lock as claimed in claim 8, further comprising a rigid member which is secured to one of said doors in a location such that its movement in the direcrtion of opening of said doors is blocked by said latch when said latch is in either of its latched positions.

10. A door lock as claimed in claim 9, wherein said latch comprises a plate having a notch formed therein, said rigid member being able to pass through said notach when said latch is in its unlatched position and said plate blocking the movement of said rigid member in the direction of opening of said doors when said latch is in either of its latched positions.

11. A door lock as claimed in claim 10, wherein said actuator means comprises:

a solenoid;

a movable core which is made of a magnetic material and which is slidably disposed inside said solenoid; and a lever arm which is connected between said movable core and said shaft so as to convert the linear motion of said movable core within said solenoid into the rotation of said shaft.

12. A door lock as claimed in claim 6, further comprising a cable which is connected between said pivot arm and said latch such that the rotation of said latch is transmitted to said pivot arm and vice versa.

13. A door lock as claimed in claim 12, further comprising a rigid member which is secured to one of said doors in a location such that its movement in the direction of opening of said doors is blocked by said latch when said latch is in either of its latched positions.

14. A door lock as claimed in claim 13, wherein:

said rigid member has a first contact portion and a second contract portion; and said latch is a rigid member having a first latching portion and a second latching portion, said first latching portion confronting said first contact portion when said latch is in its first latched position, and said second latching portion confronting said second contact portion when said latch is in its second latched position.

15. A door lock as claimed in claim 14, wherein said actuator means comprises:

a solenoid; and a movable core which is made of a magnetic material and which is slidably disposed inside solenoid, said movable core being connected to said latch such that the linear movement of said movable core will cause said latch to pivot.

16. A door lock for an elevator car which is equipped with one or more sliding doors and which is disposed inside an elevator shaft having a plurality of depressions formed in a wall thereof, comprising:

a latch which is pivotably mounted on said elevator car and which can pivot between a first latched position in which it latches said doors in a closed position, a second latched position in which it latches said doors in a closed position, and an unlatched position in which said elevator car doors are free to open;

a pivot arm which is pivotably mounted on said elevator car and which can rotate between a first latched position in which it contacts said wall of said elevator shaft, a second latched position in which it is rotated away from and does not contact said wall of said elevator shaft, and an unlatched position in which its contacts one of said depressions, said latch and said pivot arm being linked together so as to rotate together between said latched positions and said unlatched positions, said pivot arm being in its first latched position, its second latched position, or its unlatched position when said latch is in its first latched position, its second latched position, or its unlatched position, respectively;

biasing means for biasing said pivor arm towards said wall; and electrically-controlled actuator means for moving said pivot arm and said latch to their second latched positions, wherein said depressions are disposed such that when said pivot arm contacts one of said depressions, said elevator car is located where it is safe to open said elevator car doors.

* * * * *

UNITED STATES PATENT AND TRADEMARK OFFICE

CERTIFICATE OF CORRECTION

PATENT NO. : 4,934,488

DATED : June 19, 1990

INVENTOR(S) : Umemura

It is certified that error appears in the above-identified patent and that said Letters Patent is hereby corrected as shown below:

Column 10, line 46, after "is" insert --in--.

Column 12, line 2, after "inside" insert --said--.

Signed and Sealed this

Seventeenth Day of March, 1992

*Attest:*

HARRY F. MANBECK, JR.

*Attesting Officer*

*Commissioner of Patents and Trademarks*